United States Patent [19]

Nakatani et al.

[11] Patent Number: 4,580,512

[45] Date of Patent: Apr. 8, 1986

[54] METHOD OF AND APPARATUS FOR FEEDING FABRIC TO A SEWING MACHINE

[75] Inventors: Toshio Nakatani; Atsumi Ohshima, both of Aichi, Japan

[73] Assignee: Nakanihon Juki Co., Ltd., Japan

[21] Appl. No.: 668,840

[22] Filed: Nov. 6, 1984

[30] Foreign Application Priority Data

Nov. 16, 1983 [JP] Japan ..... 58-215634

[51] Int. Cl.[4] ..... D05B 21/00; D05B 35/04

[52] U.S. Cl. ..... 112/147; 112/262.2; 112/121.15; 112/2; 112/141

[58] Field of Search ..... 112/262.2, 121.12, 121.15, 112/141, 142, 143, 2, 121.29, 10, 63, 121.11, 147, 303

[56] References Cited

U.S. PATENT DOCUMENTS

| | | | |
|---|---|---|---|
| 3,736,895 | 6/1973 | Farrar et al. | 112/147 |
| 3,865,058 | 2/1975 | Rovin et al. | 112/143 X |
| 3,968,760 | 7/1976 | Rovin et al. | 112/262.2 |
| 4,068,603 | 1/1978 | Arbter | 112/121.11 |
| 4,098,201 | 7/1978 | Adamski, Jr. et al. | 112/262.2 X |
| 4,191,117 | 3/1980 | Torre | 112/141 X |
| 4,484,532 | 11/1984 | Norz | 112/141 X |
| 4,539,924 | 9/1985 | Bell, Jr. et al. | 112/262.2 |

FOREIGN PATENT DOCUMENTS

| | | |
|---|---|---|
| 2130377 | 12/1971 | Fed. Rep. of Germany . |
| 2544409 | 4/1977 | Fed. Rep. of Germany . |
| 2808806 | 9/1978 | Fed. Rep. of Germany . |
| 3047972 | 7/1982 | Fed. Rep. of Germany . |
| 2090298 | 7/1982 | United Kingdom . |

*Primary Examiner*—Werner H. Schroeder
*Assistant Examiner*—Andrew M. Falik
*Attorney, Agent, or Firm*—Robbins & Laramie

[57] ABSTRACT

A method and apparatus for feeding a tubular fabric to a sewing portion of a sewing machine so as to set a hem on the edge portion of the fabric formed as a twice-folded, three-layered band. The operation is performed so that a left rear clamp is moved to the right so as to contact a holder extending from the sewing portion on its left side; the tubular fabric is inserted around the holder from the free end thereof; a main left front clamp is moved to the right and a right front clamp is moved to the left so as to clamp intermediate portions of the peripheral surface of said fabric from the outside. Then the left rear clamp is moved to the left and a main right rear clamp is moved to the right so as to stretch right and left sides of the fabric closer to the sewing portion from the inside to the outside, so that the right and left sides of the fabric become wider than the clamped portions of the fabric. Then the left rear clamp and main right rear clamp, while stretching the fabric, are moved toward the clamped portions of the fabric along the holder, so that the edge portion of the fabric forms a twice-folded, three-layered band.

5 Claims, 18 Drawing Figures

METHOD OF AND APPARATUS FOR FEEDING FABRIC TO A SEWING MACHINE

BACKGROUND OF THE INVENTION

1. Field of the Invention

The present invention relates to a technique of feeding a piece of fabric formed as a tubular or a cylindrical shape to a sewing portion of a sewing machine as as to sew a hem portion of the fabric.

2. Description of the Prior Art

To perform the so-called lapped-edge stitching (see FIGS. 16A, 16B and 16C) using a hem-stitching sewing machine by means of a chain stitch, a fabric edge-lapping tool such as a twicefolding tool and a fabric edge detector have conventionally been provided at a position closer to the fabric feeding direction of the sewing portion of a sewing machine. The fabric edge-lapping tool is operated manually when inserting a piece of fabric so as to form a twice-folded, three-layered band 38, 39 (see FIGS. 16A, 16B and 16C) along one edge portion of the fabric. The fabric edge detector detects the edge of the fabric while feeding the fabric in such a way as to perform the so-called overlock stitching as the overcasting stitches accurately enwrap the thickness of the folded fabric portion and the outermost fabric end, and moves horizontally by intersecting at right angles the feeding direction of the fabric.

Accordingly, the fabric edge-lapping tool and the fabric edge detector do not serve as obstacles in the case of a flat-shaped piece of fabric. However, in the case of a cylindrically-shaped piece of fabric, and particularly when the diameter of the cylinder is small, for instance, the the case of the edge of a sleeve of a child's shirt, the fabric edge-lapping tool and the fabric edge detector serve as obstacles even if the sleeve is inserted around the cylindrically shaped bed of a so-called free arm sewing machine. It has been extremely difficult and practically impossible to feed the fabric and accurately perform overlock stiching while manually inserting the edge of fabric into the fabric edge-lapping tool and making the edge of the fabric three-layered.

SUMMARY OF THE INVENTION

Accordingly, an object of the invention is to remove the drawbacks of the prior art by providing a method of feeding a piece of fabric to a sewing machine and an apparatus therefor which, even if the fabric has a very small diameter, will render the conventional fabric edge-lapping tool unnecessary, eliminate manual handling of the fabric which has hitherto required skilled art, and is capable of feeding the edge of the fabric by accurately and mechanically folding the same, by feeding the edge of the fabric to the sewing portion of an overcasing sewing machine after making the edge portion of a cylindrically shaped fabric into a three-layered band in advance, and which will permit a smooth feeding of the fabric without the fabric edge detector serving as an obstacle and will enable the provision of an accurate lapped-edge stitching using the overcasting sewing machine so as to make it possible to cope with a change in the diameter of a cylindrically shaped fabric.

According to the present invention, a method for sewing a hem of a cylindrical fabric to a sewing machine is characterized by comprising the steps of: sewing one edge of a piece of flat-shaped fabric with the other edge thereof so as to make the fabric into a cylindrical shape; inserting the cylindrical fabric around a cylindrical holder extending from a sewing portion of the sewing machine so as to support the fabric around the holder; clamping right and left intermediate portions of the peripheral surface of the fabric onto the holder from the outside; stretching right and left portions of the fabric closer to the sewing portion from the inside toward the outside so that the right and left portions are expanded in the right and left directions slightly more than the clamped portions of the fabric; moving the stretched portions of the fabric toward the clamping intermediate portions of the fabric until the stretched portions are disposed over the clamped portions, so that the fabric is folded twice and the edge of the fabric on the outermost side slightly projects from the edge of an inner folded, clamped portion of the fabric; pressing the folded portion of the fabric from the outside; moving the pressed portion of the fabric in the pressed state backwardly to the sewing portion in parallel with the holder; and releasing the pressing and clamping of the folded portion of the fabric.

In a sewing machine having a sewing portion including: a needle for holding an upper thread and moving vertically, a thread catching device which is located underneath the needle and operates in such a manner so as to catch the upper thread loop and form a seam, a presser foot for resiliently pressing a piece of fabric, and a feed gear which is located underneath the presser foot and operates in such a manner as to feed the fabric in cooperation with the presser foot, an apparatus for feeding a tubuler fabric into the sewing machine according to the present invention which consists of a holder extending horizontally in a cylindrical shape from the sewing portion of the sewing machine and having a free end from which a cylindrical fabric is inserted; a left rear clamp located to the left of the holder, the left rear clamp being movable right and left so that the left rear clamp is brought into contact with the holder on its left side, and movable back and forth in parallel with the holder; a main left front clamp located to the left of the holder, the main left front clamp being movable right and left so that the main left front clamp is brought into contact with the holder on its left side, and movable back and forth in parallel with the holder; an auxiliary left front clamp opposed to the main left front clamp, the auxiliary left front clamp being movable right and left so that the auxiliary left front clamp is brought into contact with the main left front clamp on its left side, and movable back and forth together with the main left front clamp; a main right rear clamp located normally to the left of the holder, the main right rear clamp being movable right and left across the holder and movable back and forth in parallel with the holder; an auxiliary right rear clamp opposed to the main right rear clamp, the auxiliary right rear clamp being movable right and left so that the auxiliary right rear clamp is brought into contact with the main right rear clamp on its right side and movable back and forth together with the main right rear clamp; a right front clamp located to the right of the holder, the right front clamp being movable right and left so that the right front clamp is brought into contact with the holder on its right side and movable back and forth in parallel with the holder.

DESCRIPTION OF THE PREFERRED EMBODIMENTS

Figure 1:
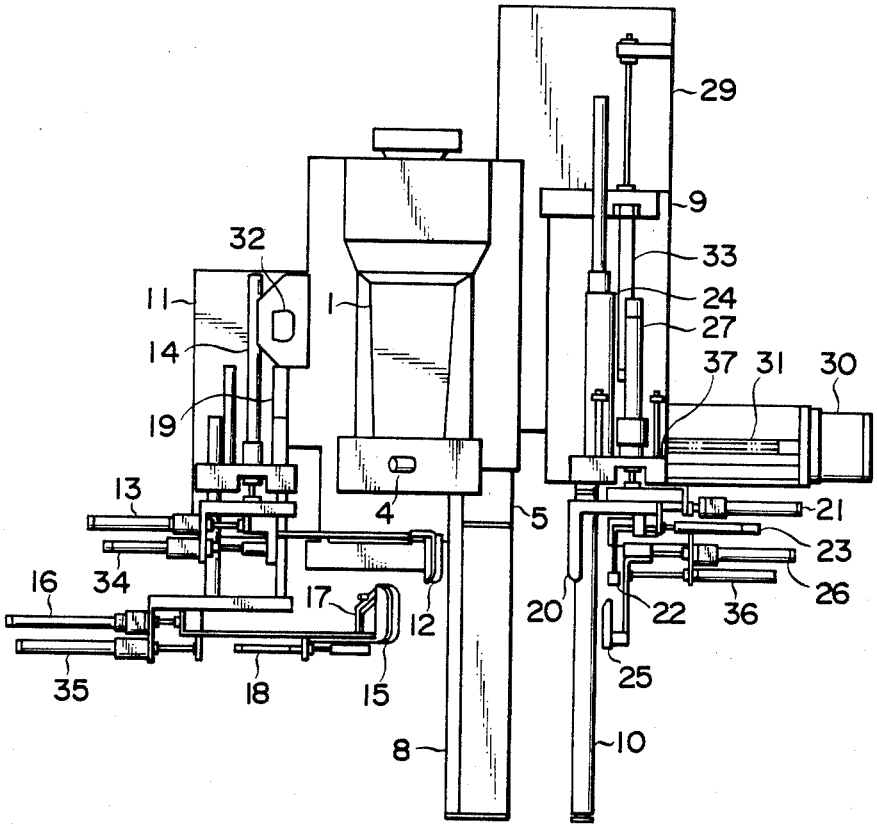
FIG. 1 is a top plan view of the overall apparatus according to the present invention.

Description of an embodiment of the present invention of the application will be made hereinunder with particular reference to FIGS. 1 to 16. In the specification, the term "right" is defined to be right on FIGS. 1 and 2 and "left" to be left on FIGS. 1 and 2, and the term "forward" is defined to be downward on FIG. 1 and "backward" to be upward on FIG. 1.

The sewing machine has a sewing portion with the following arrangement. An arm 1 of the sewing machine supports: a needle 2 for supporting an upper thread and movable vertically; and a presser foot 4 for pressing a fabric 3 by means of a resilient force. A bed 5 of the sewing machine supports the following: a looper 6 which is situated immediately below the needle 2 and moves back and forth in such a way that a loop seam for an edge of the fabric is formed in cooperation with the needle 2 by catching an upper thread loop created by the needle 2 through friction as the needle 2 rises after penetrating the fabric; and a feeding gear which is situated below the presser foot 4 and operates by appearing and disappearing from the bed 5 in such a way as to feed the fabric 3 linearly to the left on the bed 5 in cooperation with the presser foot 4.

The bed 5 integrally forms a support 8 extending horizontally in a cylindrical shape from the sewing portion of the sewing machine forwardly toward the operator. A supporting base plate 9 distanced to the right from the arm 1 and the bed 5 supports an extending body 10 which is situated to the right of the support 8 in parallel with and at the same height as the support 8 and extends horizontally in a bar shape from its backward position opposite to the sewing portion toward the operator. The base plate 9 forms a support for inserting and holding the fabric 3 together with the support 8.

A base plate 11 secured at a distance to the left from the arm 1 and the bed 5 supports: a left rear clamp 12 normally situated to the left of the support 8 and closer to the operator forwardly from the sewing portion; and a cylinder 13 which is connected to the left end of the left rear clamp 12 and is operated by the supply of a pressure fluid so that the left rear clamp 12 moves right and left and comes into contact with the left side of the support 8. A cylinder 34 may preferably be interlinked with the left rear clamp 12 so as to cause the left rear clamp 12 to move away to the left. The base plate 11 further supports a cylinder 14 which is operated by the supply of a pressure fluid and is connected to the left rear clamp 12 and the cylinders 13, 34 so that they move back and forth in parallel with the support 8.

The base plate 11 also supports: a main left front clamp 15 located to the left of the support 8 and at a position closer to the operator than the left rear clamp 12 or forwardly of the left rear clamp 12; and a cylinder 16 which is connected to the left side of the main left front clamp 15 and operates by the supply of a pressure fluid. The main left front clamp 15 is interlinked wth the cylinder 16 so that it comes into contact with the left side of the support 8 by the cylinder 16. Also, a cylinder 35 for moving the main left front clamp 15 away to the left is interlinked with the main left front clamp 15.

The main left front clamp 15 supports: an auxiliary left front clamp 17 opposed to the main left front clamp 15 in the longitudinal (back and forth) and transverse (right and left) directions; and a cylinder 18 which is conected to the left side of the auxiliary left front clamp 17 and is operated by the supply of a pressure fluid so as to move the auxiliary left front clamp 17 to right and left in such a manner as to come into contact with the left side of the main left front clamp 15 and move away from the same.

The base plate 11 also supports a cylinder 19 which is operated by the supply of a pressure fluid so as to drive the main and auxiliary left front clamps 15, 17 and the cylinders 18, 35 back and forth in parallel with the support 8.

The base plate 9 supports: a main right rear clamp 20 normally located slightly to the left of the extending body 10 and at a position closer to the operator than the sewing portion; and a cylinder 21 which is connected to the right side of the main right rear clamp 20 and operated by the supply of a pressure fluid. The main right rear clamp 20 is moved by the cylinder 21 from the left of the extending body away to the right of the same.

The main right rear clamp 20 supports: an auxiliary right rear clamp 22 opposed to the main right rear clamp 20 in the longitudinal (back and forth) and transverse (right and left) directions; and a cylinder 23 which is connected to the right side of the auxiliary right rear clamp 22 and is operated by the supply of a pressure fluid. The auxiliary right rear clamp 22 is interlinked by the cylinder 23 with the main right rear clamp 20 so that the former comes into contact with the right side of the latter and departs from the same.

The base plate 9 supports a cylinder 24 which is operated by the supply of a pressure fluid so as to move the main and auxiliary right rear clamps 20, 22 and the cylinder 23 back and forth in parallel with the extending body 10.

The base plate 9 also supports: a right front clamp 25 located normally to the right of the extending body 10 and at a position closer to the operator than the main and auxiliary right rear clamps 20, 22 or forwardly of the right rear clamps; and a cylinder 26 which is connected to the right side of the right front clamp 25 and is operated by the supply of a pressure fluid so that the right front clamp 25 comes into contact with the right side of the extending body 10. Further, a cylinder 36 is interlocked with the right front clamp 25 so that the later departs to the right of the extending body 10. Further, the base plate 9 supports a cylinder 27 which is operated by the supply of a pressure fluid so that the right front clamp 25 and the cylinders 26, 36 move back and forth in parallel with the extending body 10.

Figure 2:
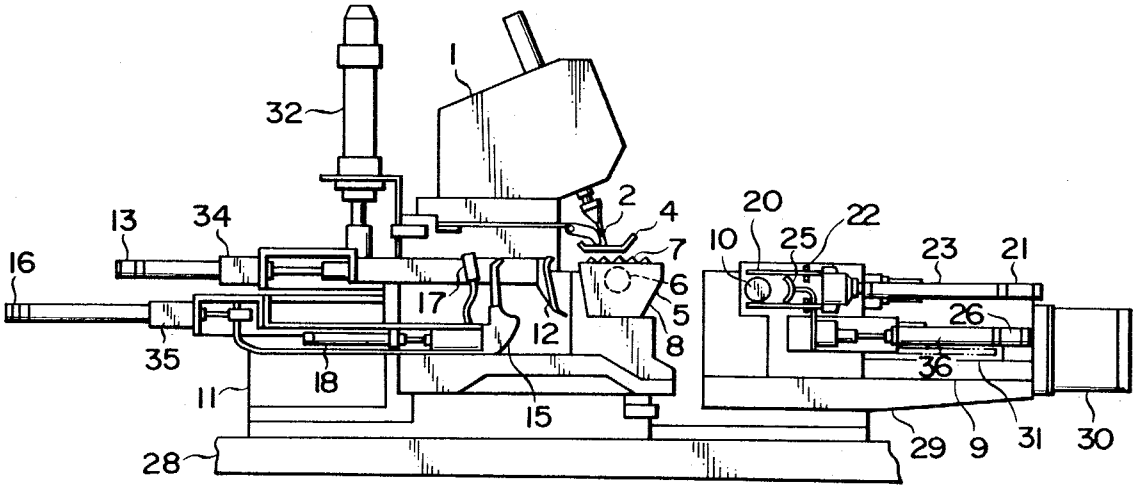
FIG. 2 is a front elevational view of the apparatus shown in FIG. 1.
Figure 3:
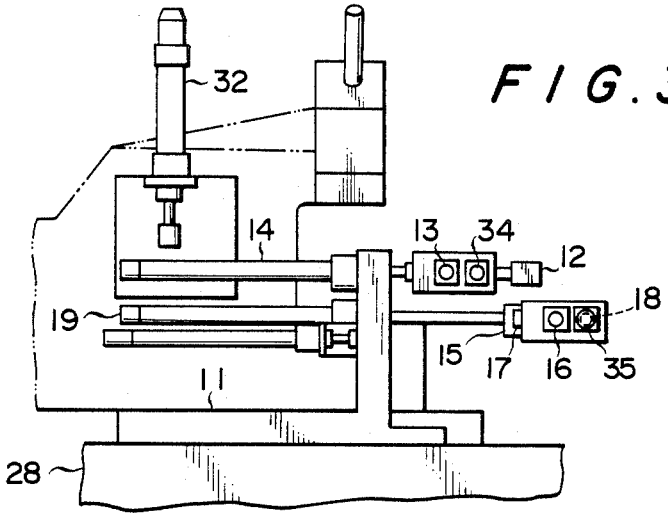
FIG. 3 is a left side elevational view of the apparatus shown in FIG. 1.
Figure 4:
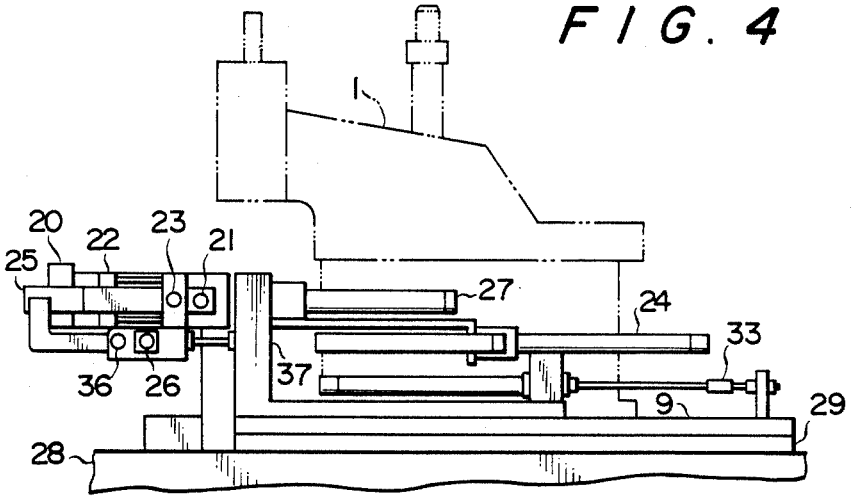
FIG. 4 is a right side elevational view of the apparatus shown in FIG. 1.

On a table 28 to which the sewing machine arm 1 and the bed 5 are secured, the base plate 11 is secured to the left of the sewing machine, and a base 29 to the right thereof as shown in FIG. 2. The base plate 9 is supported movably back and forth on the base 29. The base plate 9 is moved back and forth by means of the operation of a cylinder 33 located between the base plate 9 and the base 29. The base plate 9 supports a base plate 37 movably to right and left (see FIG. 4). A servo motor 30 secured to the base plate 9 supports the right side of a screw 31 with its left portion screwed into the base plate 37, The screw 31 is rotated forwardly or reversely by the forward or reverse rotation of the motor 30. The three right-hand clamps 20, 22 and 25 supported on said base plate 37 as well as the six cylinders 21, 23, 24, 26, 27, and 36 are caused to move to right and left together with the base plate 37 by the motor 30.

Also, a cylinder 32 is secured onto the base plate 11 so as to interlink said cylinder 32 and the presser foot 4 so that the latter is vertically movable by the supply of a pressure fluid to the cylinder 32.

Preprogrammed output signals of a microcomputer are coupled with each cylinder on both sides so as to cause each clamp at the right and left positions and the presser foot to operate as described in the following section, or are coupled with a combination of timers, thereby to supply or discharge air or a liquid.

Figure 5:
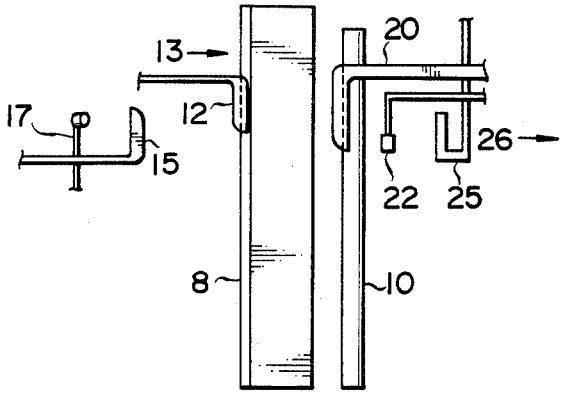
FIGS. 5 to 15, inclusive, are top plan views illustrating the operational conditions of the fabric and essential parts of the apparatus, respectively.

The embodiment according to the present invention of the application has the aforementioned arrangement. An explanation of the operation is described as follows below with particular reference to FIGS. 5 to 15:

a. As shown in FIG. 5, the left rear clamp 12 is caused to come into contact with the left side of the support 8 by the operation of the cylinder 13. The main and auxiliary left front clamps 15, 17 are moved away to the left of the support 8.

Figure 6:
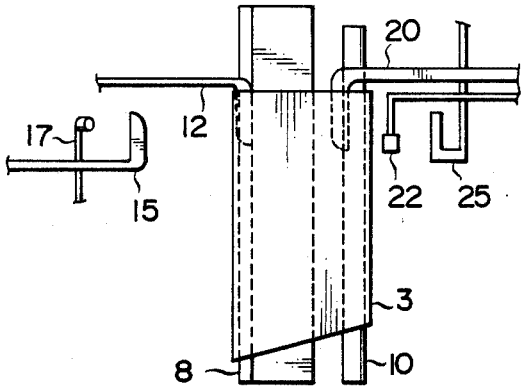
Figure 7:
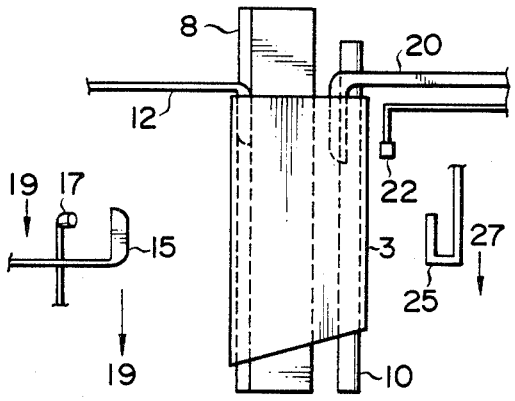
Figure 8:
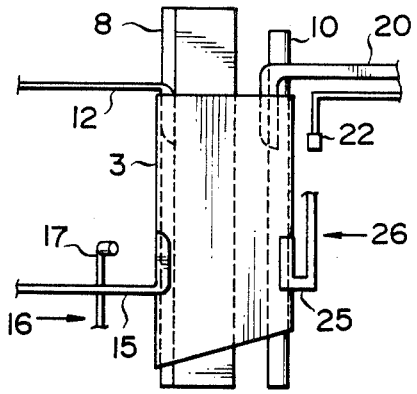
Figure 9:
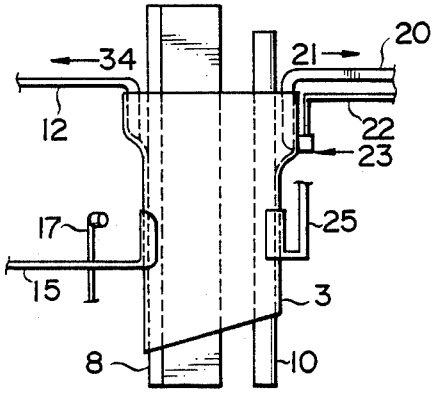
Figure 10:
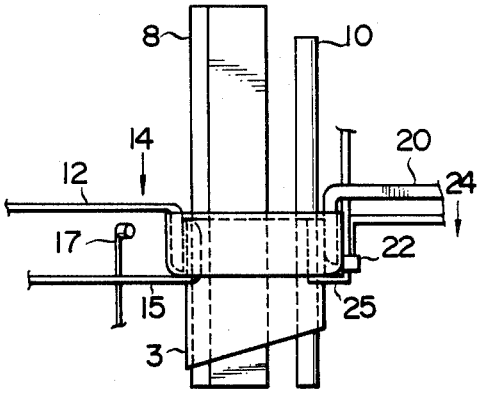
Figure 11:
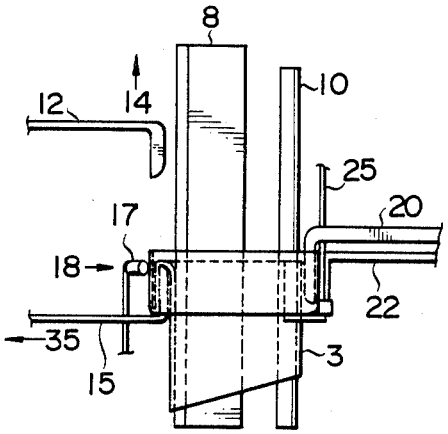
Figure 12:
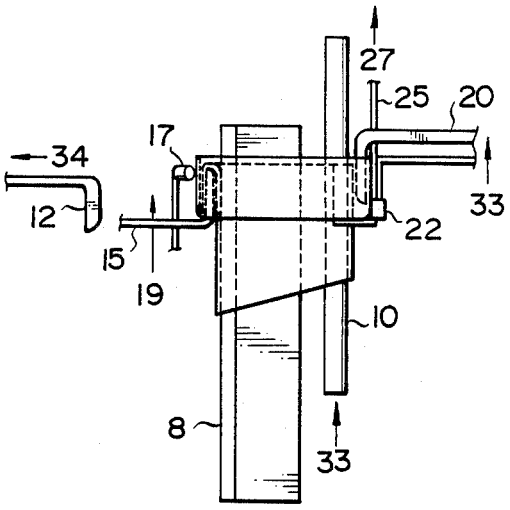
Figure 13:
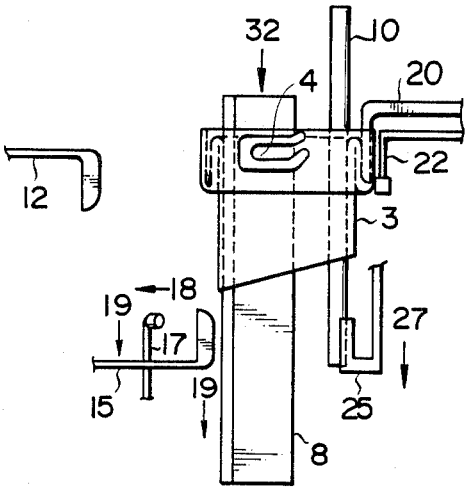
Figure 14:
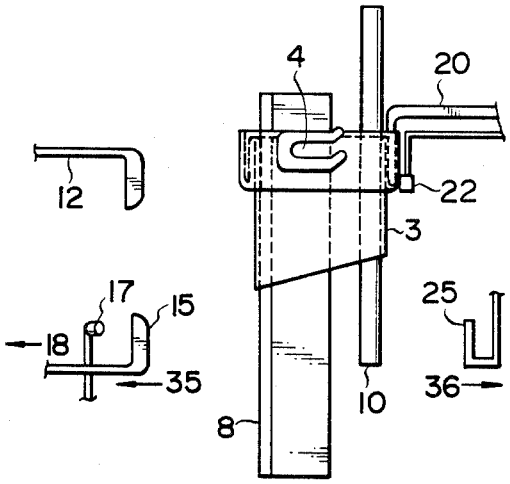
Figure 15:
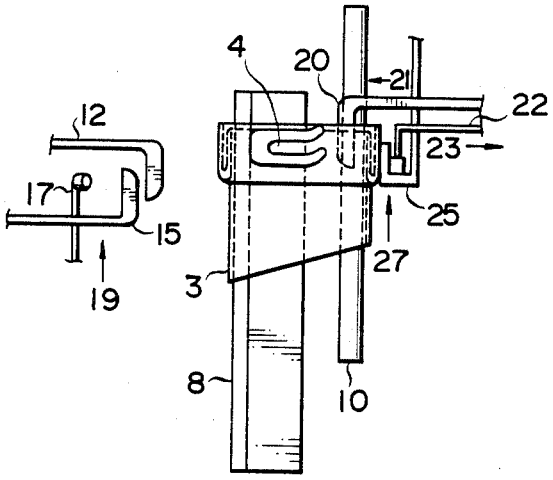
Figures 16A, 16B, 16C:
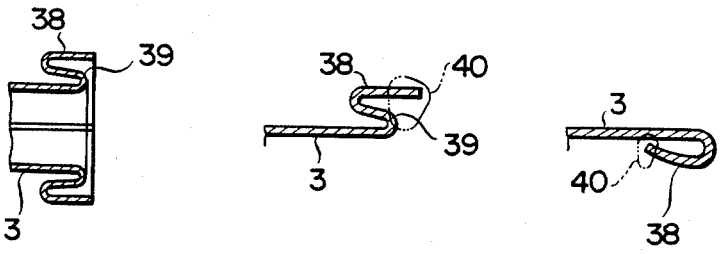
FIG. 16A is a sectional view showing a twice-folded, three-layered band at the edge of a piece of a cylindrical fabric.
FIG. 16B is a partial sectional view showing the overlock stitching.
FIG. 16C is a partial sectional view showing a stitched, unfolded edge of the fabric.

The right front clamp 25 is moved away from the extending body 20 to the right by the operation of the cylinder 26. The main right rear clamp 20 is positioned at the left side of the extending body 10, or more specifically, at a position not protruding or distanced to the right from the extending body 10, while the auxiliary right rear clamp 22 is distanced from the extending body 10 to its right.

b. As shown in FIG. 6, the inner surface of the fabric 3 which has been made in advance into a cylindrical shape by sewing both linear edges of a flat piece of fabric, is inserted around the peripheral surfaces of the support 8 and the extending body 10 from the forward or operator's side toward the backward direction with the surface which will become the upper face of the apparel facing outward. The inner surface of the fabric 3 is caused to cover the forward portions of the left rear clamp 12 and the main right rear clamp 20 facing the operator, and is supported by the same.

c. A shown in FIG. 7, the main and auxiliary left front clamps 15, 17 are moved to the intermediate positions of the left side of the support 8 by the cylinder 19, and the right front clamp 25 is moved to the intermediate position of the right side of the extending body 10 by the cylinder 27.

d. As shown in FIG. 8, the main left front clamp 15 is moved by the cylinder 16 to its right and comes into contact with the left side of the support 8. The right front clamp 25 is moved by the cylinder 26 to its left and comes into contact with the right side of the extending body 10. As a result, the fabric 3 is supported and clamped from outside by the clamps 15 and 25.

e. As shown in FIG. 9, the left rear clamp 12 is moved slightly toward the left from the support 8 by the operation of the cylinder 34. The main right rear clamp 20 is also moved slightly toward the right from the extending body 10 by the operation of the cylinder 21. The auxiliary right rear clamp 22 clamps the fabric 3 in cooperation with the main right rear clamp 20 by moving toward the left by the operation of the cylinder 23. The edge of the cylinder fabric 3 is therefore stretched from its inner surface to the outward direction.

f. As shown in FIG. 10, the left rear clamp 12 and the main and auxiliary right rear clamps 20, 22 are moved forwardly by the operation of the cylinders 14 and 24, respectively, while maintaining the fabric 3 being stretched, and come into an overlapping position with the outer side of the main left front clamp 15 and the right front clamp 25, respectively. As a result, the fabric is folded twice in a multi-layer. The edge of the fabric on the outermost side may preferably slightly project from the edge of a folded portion of the fabric on the inner side thereof.

g. As shown in FIG. 11, the left rear clamp 12 is pulled out from the folded portion of the fabric 3 and moved backwardly by the operation of the cylinder 14. The main left front clamp 15 is moved slightly toward the left from the support 8 by the operation of the cylinder 35. The auxiliary left front clamp 17 is moved to the right by the operation of the cylinder 18, so as to press the folded portion of the fabric against the main left front clamp 15.

h. As shown in FIG. 12, the left rear clamp 12 is moved toward the left from the support 8 by the operation of the cylinder 34. The main and auxiliary right rear clamps 20, 22 together with the extending body 10 are moved backwardly to the sewing portion of the sewing machine in parallel with the support 8 by the operation of the cylinder 33, while the folded portions of the fabric 3 are pressed by the clamps in such a manner that the base plate 9 supporting the right rear clamps 20, 22 and extending body 10 is pulled backwardly by the cylinder 33 on the base 9. At the same time, the main and auxiliary left front clamps 15, 17 are also moved backwardly to the sewing portion of the sewing machine in parallel with the support 8 by the operation of the cylinder 19. The right front clamp 25 is also moved backwardly by the operation of the cylinder 27.

i. As shown in FIG. 13, the auxiliry left front clamp 17 is moved and separated from the main left front clamp 15 to the left by the operation of the cylinder 18. Then the main and auxiliary left front clamps 15, 17 and the right front clamp 25 are pulled out from the folded portion of the fabric 3 by the operation of the cylinders 19 and 27, respectively, so as to release the clamping and pressing at the left side of the folded portion of the fabric. Then the presser foot 4 is lowered to the folded portion of the fabric by the operation of the cylinder 32.

j. As shown in FIG. 14, the main and auxiliary left front clamps 15, 17 and the right front clamp 25 are moved and separated to the right and left sides of the support 8 and the extending body 10 by the operation of the cylinders 16, 18, and 36, respectively.

k. As shown in FIG. 15, the main right rear clamp 20 is moved and separated to the left side of the extending body 10 by the operation of the cylinder 21. The auxiliary right rear clamp 22 is separated to the right from the outside of the folded portion of the fabric 3 by the operation of the cylinder 23. The main and auxiliary left front clamps 15, 17 are moved backwardly toward the sewing portion of the sewing machine in parallel with the right and left sides of the support 8 and the extending body by the operation of the cylinders 19, 27, respectively. The outermost edge of the fabric 3 in this state is twice-folded as shown in FIG. 6A.

l. The sewing machine is then started, the needle 2 for holding an upper thread is moved vertically, and the fabric 3 is fed to the left with its shape being a cylindrical shape by operating the thread-catching device 6 and the feed gear 7. While the fabric 3 is being fed, the needle 2 is lowered through the thickness of the inner folded, two-layered portion 39 of the fabric 3, from the above and slightly leftwardly inner side of the outermost edge 38 of the three-layered portion of the fabric 3, as shown in FIG. 16B. At the outermost edge of the three-layered portion of the fabric 3 is formed a hem-stitch seam, while at the folded, two-layered portion 39 is formed a concealed seam 40. When the sewing machine is stopped after the entire periphery of the cylinder of the fabric 3 has been sewn, the needle 2 and the pressure foot 4 are raised from the fabric 3 and held in their raised position, the fabric 3 is moved toward the operator and is removed from the support 8 and the extending body 10. Subsequently, the outer two layers 38, 39 of the cylinder of the fabric 3 are turned over to the right with the seam 40 as a fulcrum so as to serve as the edge of a sleeve of apparel as shown in FIG. 6C.

m. When there is a change to the diameter of the cylinder of the fabric 3, the motor 30 is rotated in one direction so as to cause the base plate 37 to move to right and left, as viewed in FIG. 1, on the base 9 via the screw 31. This, in turn, causes the extending body 10, the main and auxiliary right and left clamps 20, 22, and the right front clamp 25 to move right and left in interlinked relation with the six cylinders, thereby adjusting the interval with the support 8. When it is confirmed that the relative position of the extending body 10 and the clamps have been adjusted to fit the diameter of the cylindrical fabric 3, the motor 30 can be stopped.

Since the apparatus according to the present invention has the aforementioned arrangement and operates as stated above, the apparatus has the following effects.

According to the present invention, after the fabric 3 is formed into a tubular or cylindrical shape it is fed to the sewing portion of the hem-stitching sewing machine, advancing mechanically and automatically into twice-folded, three-layered portions 38, 39, even if the fabric 3 is, for instance, a sleeve of a child's shirt having an extremely small diameter. It is unnecessary to use a fabric end-lapping tool and manual handling of the fabric for sewing the fabric while feeding the folded fabric to the sewing portion of the machine. It is unnecessary to have a skilled artisan to use a lapping tool and to do the manual handling. It is possible according to the present invention to effect the smooth feeding of the fabric without an obstacle being caused by a fabric edge detector for detecting the edge of the fabric in response to the needle of the sewing portion. It is also possible to adjust the apparatus in response to a change in the diameter of cylindrical fabric.

To change the widthwise dimension in the back and forward direction of the twice-folded, three-layered portions 38, 39 of the fabric 3, it is possible to effect the change by changing the dimension and moving distance of each clamp in the back and forward direction thereof. Also, it is possible to operate each cylinder electromagnetically. Furthermore, it is possible not only to use a hem-stitching sewing machine by means of a chain stitch but also a regular sewing machine by means of a chain stitch by folding the edge of the fabric once or twice.

What is claimed is:

1. A method of feeding a piece of fabric to a sewing machine, comprising the steps of:

a. sewing one edge of a piece of flat-shaped fabric with the other edge thereof so as to make said fabric into a cylindrical shape;

b. inserting said cylindrical fabric around a holder extending from a sewing portion of the sewing machine so as to support said fabric around said holder;

c. clamping right and left intermediate portions of the peripheral surface of said fabric onto said holder from the outside;

d. stretching right and left portions of said fabric closer to the sewing portion from the inside toward the outside so that said right and left portions are expanded in the right and left directions slightly more than said clamped portions of said fabric;

e. moving said stretched portions of said fabric toward said clamped intermediate portions of said fabric until said stretched portions are disposed over said clamped portions, so that said fabric is folded twice and the edge of said fabric on the outermost side slightly projects from the edge of an inner folded clamped portions of said fabric;

f. pressing said folded portion of said fabric from the outside;

g. moving said pressed portion of said fabric in the pressed state backwardly to said sewing portion in parallel with said holder; and h. releasing the pressing and clamping of said folded portion of said fabric.

2. In a sewing machine having a sewing portion including:

a needle for holding an upper thread and moving vertically, a thread loop catching device which is located underneath said needle and operates in such a manner so as to catch an upper thread loop and form a seam, a presser foot for resiliently pressing a piece of fabric, and a feed gear which is located underneath said presser foot and operates in such a manner as to feed said fabric in cooperation with said presser foot, an apparatus for feeding a piece of cylindrical fabric into said sewing machine comprising:

a. a holder extending horizontally in a cylindrical shape from the sewing portion of said sewing machine and having a free end from which a cylindrical fabric is inserted;

b. a left rear clamp located to the left of said holder, said left rear clamp being movable right and left so that said left rear clamp is brought into contact with said holder on its left side, and movable back and forth in parallel with said holder;

c. a main left front clamp located to the left of said holder, said main left front clamp being movable right and left so that said main left front clamp is brought into contact with said holder on its left side, and movable back and forth in parallel with said holder;

d. an auxiliary left front clamp opposed to said main left front clamp, said auxiliary left front clamp being movable right and left so that said auxiliary left front clamp is brought into contact with said main left front clamp on its left side, and movable back and forth together with said main left front clamp;

e. a main right rear clamp located normally to the left of said holder, said main right rear clamp being movable right and left across said holder and movable back and forth in parallel with said holder;

f. an auxiliary right rear clamp opposed to said main right rear clamp, said auxiliary right rear clamp being movable right and left so that said auxiliary right rear clamp is brought into contact with said main right rear clamp on its right side and movable back and forth together with said main right rear clamp;

g. a right front clamp located to the right of said holder, said right front clamp being movable right and left so that said right front clamp is brought into contact with said holder on its right side and movable back and forth in parallel with said holder;

wherein means are provided to move said clamps and said presser foot in the following order to effect the following operations on a cylindrical fabric inserted around the holder from its free end thereof;

h. said left rear clamp is moved to the right so as to contact with the holder on its left side;

i. said main left front clamp is moved to the right and said right front clamp is moved to the left so as to clamp intermediate portions of the peripheral surface of said fabric onto said holder from the outside;

j. said left rear clamp is moved to the left and said main right rear clamp is moved to the right so as to stretch right and left sides of the fabric closer to the sewing portion from the inside to the outside, so that said right and left sides of the fabric become slightly wider than said clamped portions of said fabric;

k. said left rear clamp and said main right rear clamp, while stretching the fabric, are moved toward said clamped portions of the fabric along the holder until said left rear clamp and said main right rear clamp are disposed over said clamped portions, so that said fabric forms a twice-folded, three-layered band and the edge of the outermost side slightly projects from an edge on an inner folded clamped portion of the fabric;

l. said auxiliary left front clamp and said auxiliary right rear clamp are moved to the right and left, respectively, toward the holder so as to press said folded portion from the outside;

m. said main and auxiliary left front clamps and said main and auxiliary right rear clamps are moved toward the sewing portion along the holder so as to move said pressed folded fabric toward the sewing portion;

n. said presser foot is lowered so as to resiliently press said pressed folded fabric; and o. said main and auxiliary left front clamps and said main and auxiliary right rear clamps are released from said fabric.

3. An apparatus as set forth in claim 2, wherein at the time of pressing said folded portion of the fabric by said auxiliary left front clamp and said auxiliary right rear clamp, further means are provided to release said left rear clamp from the fabric.

4. An apparatus as set forth in claim 2, wherein said holder comprises:

a support extending horizontally in a cylindrical shape from the sewing portion of said sewing machine and having a free end; and an extending body spaced to the right of said support and extending in a bar shape in parallel with and at the same horizontal level as said support.

5. An apparatus as set forth in claim 4, further comprising:

a first base plate supporting said extending body, said main and auxiliary right rear clamps and said right front clamps and being movable back and forth in parallel with said support; and a second base plate supported by said first base plate and being movable right and left on said first base plate, said second base plate further supporting said extending body, said main and auxiliary right rear clamps and said right front clamp, whereby said extending body, said main and auxiliary right rear clamps and said right front clamp are integrally movable back and forth in parallel with and perpendicular to said support.

* * * * *